US005495080A

United States Patent [19]

Periou et al.

[11] Patent Number: 5,495,080

[45] Date of Patent: Feb. 27, 1996

[54] ELECTRICAL SWITCH

[75] Inventors: Pierre Periou, Cergy Pontoise; Enrico Fin, Paris, both of France

[73] Assignee: Rockwell Body and Chassis Systems, France

[21] Appl. No.: 169,814

[22] Filed: Dec. 17, 1993

[30] Foreign Application Priority Data

Dec. 21, 1992 [FR] France ..... 92 15414

[51] Int. Cl.[6] ..... H01H 1/26

[52] U.S. Cl. ..... 200/283; 200/275; 200/553; 200/238; 200/239; 200/244; 200/280

[58] Field of Search ..... 200/283, 275, 200/280, 281, 282, 284, 553, 238, 239, 241, 244, 250, 252, 253, 257, 261, 531

[56] References Cited

U.S. PATENT DOCUMENTS

| | | | |
|---|---|---|---|
| 3,222,487 | 12/1965 | Juptner | 200/283 |
| 3,250,882 | 5/1966 | Campbell et al. | 200/241 |
| 3,946,185 | 3/1976 | Gruner | 200/245 |
| 4,035,596 | 7/1977 | Marguardt | 200/275 |
| 4,081,632 | 3/1978 | Schaffeler | 200/275 |
| 4,277,663 | 7/1981 | Soes | 200/283 |
| 4,789,764 | 12/1988 | Doros | 200/241 |
| 5,382,767 | 1/1995 | Takano et al. | 200/531 |

FOREIGN PATENT DOCUMENTS

| | | |
|---|---|---|
| 0016550 | 10/1980 | European Pat. Off. . |
| 2437615B1 | 1/1976 | Germany . |
| 2434272A1 | 2/1976 | Germany . |
| 2841675 | 2/1981 | Germany . |
| 1712976A1 | 2/1993 | U.S.S.R. . |
| WO90/10943 | 9/1990 | WIPO . |

*Primary Examiner*—Henry J. Recla
*Assistant Examiner*—David J. Walczak

[57] ABSTRACT

This electrical switch (1) consists of a flat spring, profiled in order to provide both a contact function and a spring function; the flat spring (1) includes a first leg (2) which can be deformed by bearing on a fixed pivot pin (3) of a support (4), and a second leg (5), which can move at the same time as the first leg deforms and whose end (5*a*) can assume either of two positions for contacting pins (14,15) of an electrical circuit. The switch according to the invention is less bulky than the usual switches by virtue of its flat shape, less expensive to manufacture, because it only consists of a single component, and easy to install on its support.

10 Claims, 2 Drawing Sheets

ELECTRICAL SWITCH

The subject of the present invention is an electrical switch.

It is known that conventional electrical switches generally consist of two blades, which touch each other in order to make the contact, and of a return spring, these three components being mounted on an appropriate support.

The object of the invention is to make a switch consisting of a single component and which is therefore cheaper to manufacture and at the same time easy and quick to mount.

In accordance with the invention, the electrical switch includes at least one flat spring, profiled and prestressed so as to be able to provide both a contact function and a spring function.

This flat spring, once fastened to a suitable support, can operate as a reversing switch (with two, rest and working, contacts) or only as a contactor, with a single contact. The shape of the spring can be very variable, but in all cases the fact that it is flat reduces its bulk with respect to that of the usual switches.

According to one embodiment of the invention, the switch includes a first leg which can be deformed by bearing on a fixed pivot pin of a support, and a second leg which can move at the same time as the first leg and whose end can assume either of two positions, whereas the end of the first leg remains fixed.

Other characteristics and advantages of the invention will appear during the description which follows, given by way of reference to the appended drawing which illustrates three embodiments by way of non-limiting examples.

Figure 1:
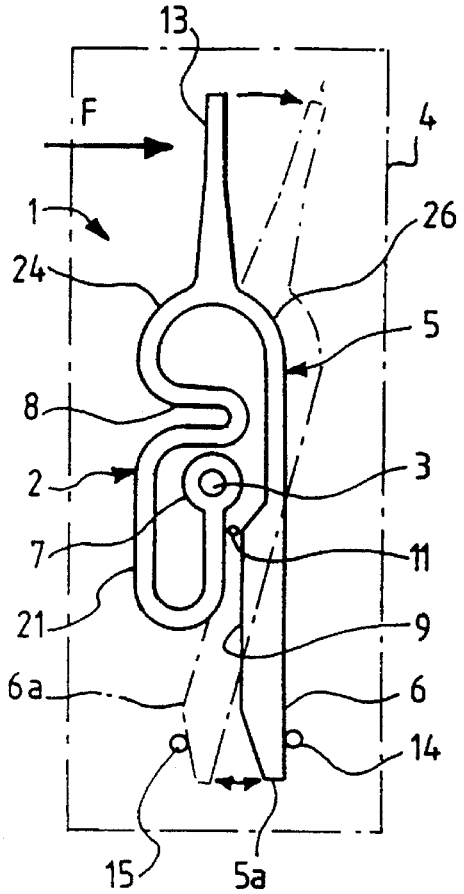
FIG. 1 is a plan view from above, on an enlarged scale, of a first embodiment of the switch according to the invention, mounted on a support plate.

The electrical switch 1 represented in FIG. 1 consists of a flat spring, profiled and prestressed in order to be able to provide both a contact function and a spring function. The switch 1 includes a first leg 2 which can be deformed by bearing on a fixed pivot pin 3 of a support plate 4, and a second leg 5, which can move at the same time as the first leg 2. The end 6 of the leg 5 can assume either of two positions: one represented by the continuous line, and the other by the dot-dash line 6*a*.

The leg 2 ends in a end hole 7 suitable to be slipped over the pivot pin 3 and attached to it. The leg 2 can have a variable geometry, with, for example, a substantially U-shaped or V-shaped doubly folded part 8, whereas the leg 5 is, in this example, substantially straight, extending in a general direction approximately parallel to the general direction of the leg 2. The latter includes, starting from the pivot pin 3 and from its pin-end hole 7, a hairpin-shaped part 21 followed by the U-shaped doubly folded part 8 extended by a bent-round end part 24.

The leg 5 includes a hump 9 extending longitudinally starting from its tip 5*a* towards a bearing stop 11 attached to the support plate 4. The thickness of the hump 9 may be constant, or variable as shown. Opposite the bearing stop 11, the hump 9 has an end ramp 9*a* which is connected to the thinned base of the leg 5. Beyond the ramp 9*a*, the leg 5 includes a straight portion which is prolonged by a bent-round part 26 facing the bent-round part 24. These two parts 24, 26 join up at the base of a foot 13.

An actuating member, not shown, of the switch, such as a cam exerting a thrust directed along the arrow F, can bear laterally on this foot 13.

Figure 2:
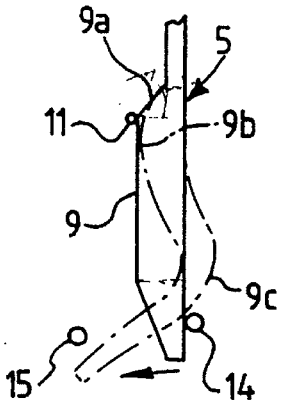
FIGS. 2 and 3 are partial plan views showing the two positions which the end of the second leg of the spring of FIG. 1 can assume.
Figure 3:
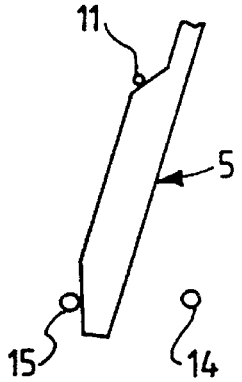

At rest, the switch 1 is in the position represented by the continuous line in FIG. 1. The bearing point 14 is positioned with respect to the pivot pin 3 and to the leg 5 in such a way that the latter exerts a defined elastic force on the point 14. When the actuating member exerts the thrust F on the foot 13, the spring deforms progressively about its fixed bearing 3. The leg 5 moves away from the contact 14 until it comes to assume the position 6*a* shown by the dot-dash line, in which the tip 5*a* comes into contact with a second pin 15 of an electrical circuit, not shown. During the deformation and the pivoting of the entire spring 1 about the fixed pivot pin 3, the stop 11 slides progressively over the inclined ramp 9*a*, corresponding to a lesser thickness of the hump (FIGS. 2 and 3). This sliding decreases the resistance encountered by the hump 9 and therefore makes it easier for the end 5*a* to come into contact with the pin 15.

When the load F on the foot 13 disappears, the spring 1 automatically comes back to its initial position by spring-back, exerting by means of its end 6, on the contact 14, a defined and constant pressure established as soon as the electrical contact is made and related to the prestress of the spring. The shapes of the hump 9 opposite the stop 11 and opposite the pin 15 may be adapted, for example by rounded parts 9*b* and 9*c* (FIG. 2), in order to prevent excessive pressure on the contact 15, liable to cause deterioration of the spring, and to allow overtravel without excessive stressing.

Figure 4:
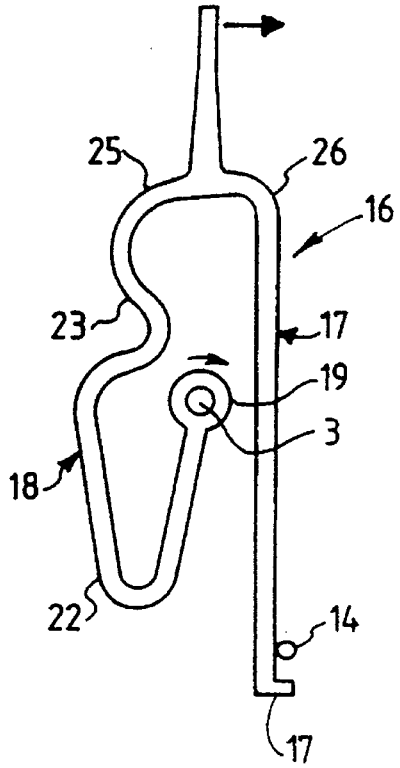
FIG. 4 is a view similar to FIG. 1 of a second embodiment of the switch according to the invention.

The second embodiment of the switch 16, represented in FIG. 4, constitutes, no longer a reversing switch but a contactor, the pin 15 having been dispensed with. It differs from the previous one by the fact that the second, straight leg 17 does not include a longitudinal hump, while the first leg 18 has a more open configuration than that of the leg 2 of the spring 1.

Thus, starting from the pin-hole 19 receiving the pivot pin 3, the leg 18 includes a hairpin-shaped part 22 and then a widely open V-shaped doubly folded part 23 and a rounded end 25 connected to the foot 13. Finally, the latter is connected to the leg 17 via a bent-round part 26. Tilting of the spring 16 about the pin 3 moves the leg 17 away from the contact 14 and therefore opens the corresponding electrical circuit.

Figure 7:
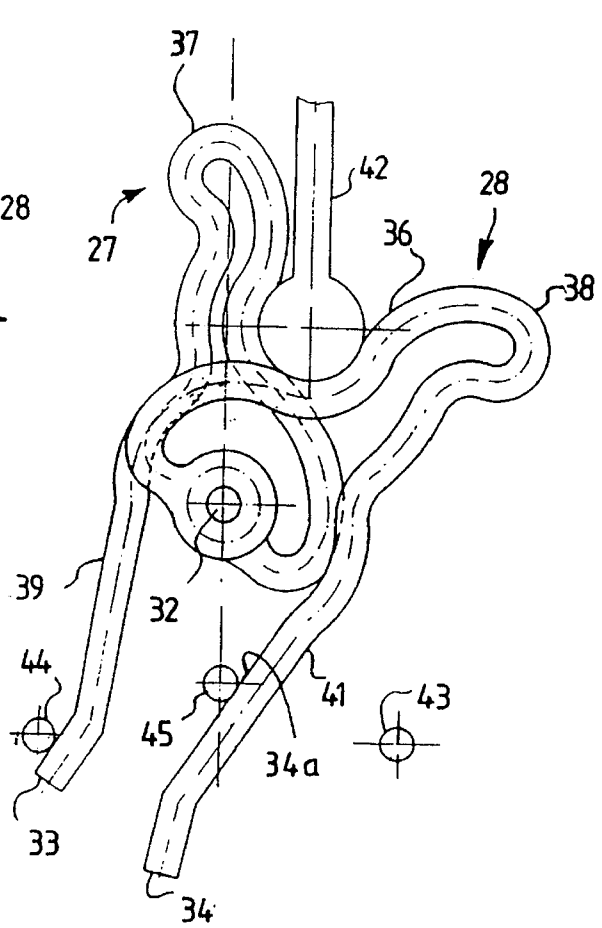
FIGS. 5 to 7 are plan views, on an enlarged scale, of a third embodiment of the switch according to the invention and of its three possible positions.
Figure 5:
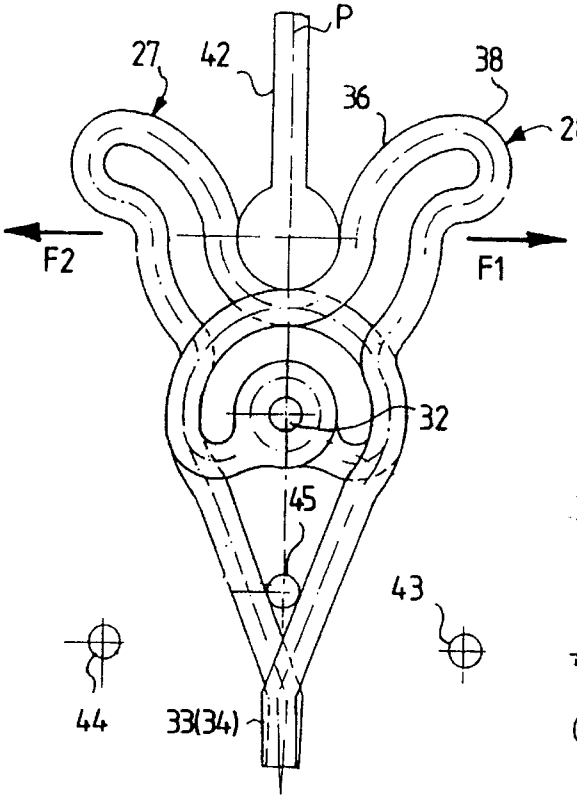
Figure 6:
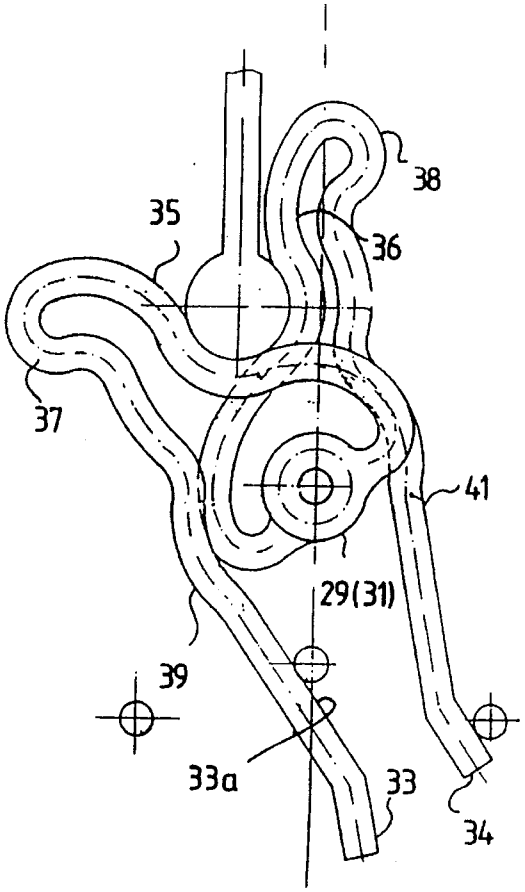

In the third embodiment of the invention, illustrated in FIGS. 5 to 7, the switch comprises two superimposed springs 27 and 28 which are identical, prestressed and deformable, one end 29, 31 of which is attached to a pivot pin 32 and the opposite ends 33, 34 of which form movable end feet. The stack formed by the two springs 27, 28 is symmetrical with respect to a plane P perpendicular to the general plane of the stack and passing through the pivot pin 32.

The configuration of each spring 27, 28 is more particularly apparent in FIGS. 6 and 7: each includes, starting from its end 29, 31 attached to the pivot pin 32, a first, curved part 35, 36, a doubly folded part 37, 38 and an approximately straight leg 38, 39 which ends in a foot 33, 34. The conformation of the springs is such that their various parts are symmetrical with respect to the mid-plane P when they are both in the prestressed position with their end heads 33, 34 superimposed (FIG. 5. In this position, the curved parts 35 and 36 delimit a bearing surface for a member 42 for pushing on either of the said curved parts 35, 36, in opposite directions symbolized by the arrows F1 and F2 (FIG. 5). The stack of the springs 27, 28 is placed on a support (not shown) equipped with three pins 43, 44, 45. The pins 43, 44 are placed on each side of the feet 33, 34, at an appropriate distance, and constitute contacts of an electrical circuit, not shown. The pin 45 is positioned between the legs 39 and 41 for which it can act as a bearing element.

Each end foot 33, 34 is connected to a section forming a ramp (33*a*, 34*a*) for the sliding of the foot on the central pin 45 during the movements of the other foot from the central position (FIG. 5) as far as the lateral contact (FIGS. 6 and 7) or vice versa.

The operating of the switch which has just been described is as follows.

With the springs 27, 28 partially superimposed, as shown in FIG. 5, with their legs 39, 41 bearing on the central pin 45, a lateral thrust exerted on one of the curved parts 35 and 36 by the thrust member 42, for example along the arrow F2 on the part 35, deforms the latter as well as the prestressed spring 28. The leg 41 of the latter is released and tilts in the opposite direction to the thrust F2, until its end foot 34 comes into contact with the pin 43 (FIG. 6), whereas the leg 39 slides, by means of its ramp 39*a*, on the central pin 45.

A new thrust exerted in the opposite direction to the first obviously brings back the springs 27 and 28 into their position of FIG. 5. If, starting from the latter position, a thrust is exerted by the member 42 along the arrow F1, the springs 27 and 28 deform in a symmetrical manner from the previous one and come to assume the position shown in FIG. 7. In the latter position, the spring 27, which was prestressed, relaxes in such a way that its released leg 39 comes into contact with the pin 44 by means of its foot 33, while the leg 41 of the spring 28 slides, by means of its ramp 41*a*, on the pin 45 on which it remains in bearing contact.

Thus, the switch shown in FIGS. 5 to 7 may operate as a reversing switch with the two contact pins 43, 44, or, optionally, as a simple contactor by dispensing with one of them. Its advantage resides in the fact that the force exerted on the contact 43 or 44 by the foot 34 or 33 is independent of the force F1, F2 with which the member 42 is actuated, this being due to the prestress and to the particular conformation of the flat springs 27 and 28.

In the various embodiments described hereinabove, the deformation undergone by the switch takes place in the plane of the spring. The latter is flat and profiled in order to keep a given contact force, for example of the order of 100 g, in order to have great flexibility so as to obtain rapid movements, and in order to keep low mechanical stresses over the entire length of the profile of the spring, that is to say ones compatible with a long time (the stress values depending on the material used).

This profile is determined on the basis of a specific item of computer software.

The electrical switch according to the invention is capable of very many applications. It may advantageously be made from a beryllium-copper alloy which has good mechanical characteristics, comparable to those of steel, a lower elastic modulus than that of steel, corresponding to good flexibility, and finally is a good electrical conductor. Of course, this alloy is only given by way of example, it being possible for any other alloy of equivalent characteristics to be used.

In its various possible embodiments, the flat spring according to the invention combines into a single, compact component, the two functions of the usual switches. It is possible to constitute stacks of several superimposed flat springs in order to obtain assemblies of switches in accordance with the invention.

We claim:

1. An electrical switch (1; 16) comprising a support (4) having at least one fixed contact, a fixed pivot pin (3) and a fixed stop mounted thereon (11), and at least one flat spring (1) which is able to provide both a contact function and a spring function with respect to said fixed contact, said spring (1) including a first leg (2; 18) which is deformable by bearing on said fixed pivot pin (3) of said support (4) and having a first end fixed to said pivot pin and a second end, said spring (1) further including a second leg having a first end extending from said second end of said first leg (5; 17) which is movable with the first leg (2; 18), said second leg (5; 17) having a second end (5*a*; 17*a*) that can assume at least first and second positions with respect to said first contact, said second leg (5) further having a longitudinal hump (9) defined by a thickened section thereof in bearing contact against said fixed stop (11) and pivotable about said fixed stop (11) when initial movement of said second leg (5) occurs between said first and second positions in response to movement of said first leg, said longitudinal hump (9) further having an inclined end ramp (9*a*) slidable on said fixed stop (11) during subsequent movement of the second leg (5) between said first and second positions.

2. The electrical switch according to claim 1, characterized in that said spring (1; 16) includes a foot (13) projecting from the junction of said first and second legs (2,5; 18,17) upon which a thrust (F) can be exerted.

3. The electrical switch according to claim 1, characterized in that said support (4) further includes a contact (14) which is operable to engage said longitudinal hump (9), said longitudinal hump (9) having at least one rounded part adapted to allow overtravel of said second leg (5, 17) with respect to said contact (14).

4. The electrical switch according to claim 1, wherein one of said first and second positions is defined in part by a contact (14) which is disposed on said support (4), said spring (1) being operable to exert at one of said first and second positions a defined and constant pressure on said contact (14).

5. The electrical switch of claim 1, wherein said first leg (2; 18) includes a U-shaped doubly folded part (8; 23).

6. The electrical switch of claim 5, wherein said first leg (2; 18) includes a hairpin-shaped part (21; 22) disposed adjacent to said U-shaped part (8; 23).

7. The electrical switch of claim 1, wherein said first leg (2; 18) generally extends in a direction that is substantially parallel to the direction that said second leg (5; 17) extends.

8. The electrical switch of claim 1, wherein said fixed stop (11) is oriented on said support (4) so as to decrease the resistance to movement encountered by said longitudinal hump (9) as said second leg (5) moves from said first position to said second position.

9. The electrical switch of claim 1, wherein said longitudinal hump (9) has a substantially uniform thickness.

10. The electrical switch of claim 1, wherein said longitudinal hump (9) has a thickness which is longitudinally variable.

* * * * *